US011058200B2

(12) United States Patent
Winston

(10) Patent No.: US 11,058,200 B2
(45) Date of Patent: Jul. 13, 2021

(54) APPARATUS FOR ASSISTING HAIR WASHING

(71) Applicant: Danielle Winston, San Bernardino, CA (US)

(72) Inventor: Danielle Winston, San Bernardino, CA (US)

(73) Assignee: Danielle Winston, San Bernardino, CA (US)

( * ) Notice: Subject to any disclaimer, the term of this patent is extended or adjusted under 35 U.S.C. 154(b) by 0 days.

(21) Appl. No.: 16/590,204

(22) Filed: Oct. 1, 2019

(65) Prior Publication Data

US 2020/0100577 A1 Apr. 2, 2020

Related U.S. Application Data

(60) Provisional application No. 62/739,839, filed on Oct. 1, 2018.

(51) Int. Cl.
*A45D 19/10* (2006.01)
*A47K 3/12* (2006.01)

(52) U.S. Cl.
CPC ..... *A45D 19/10* (2013.01); *A47K 3/125* (2013.01); *A47K 3/127* (2013.01)

(58) Field of Classification Search
CPC ..... A45D 44/10; A45D 19/08; A45D 19/10; A47K 3/125; A47K 3/127; E03C 1/326
USPC ..... 4/519
See application file for complete search history.

(56) References Cited

U.S. PATENT DOCUMENTS 2,200,247 A * 5/1940 Haas ..... A47K 3/125 4/575.1
2,351,849 A * 6/1944 Holt ..... A45D 44/10 4/520
2,516,601 A * 7/1950 Smalls ..... A45D 19/08 4/520
D170,860 S * 11/1953 Harris ..... D23/304
2,697,480 A * 12/1954 Du Bois ..... A47D 1/002 297/325
2,818,585 A * 1/1958 Hess ..... A45D 19/04 5/632
2,876,459 A * 3/1959 Ackerson ..... A47D 13/08 4/572.1
3,244,387 A * 4/1966 Hargraves ..... A45D 19/10 248/27.5
3,633,222 A * 1/1972 Greenfield ..... A47K 3/127 4/517
3,965,496 A * 6/1976 Grelle ..... A47K 3/024 4/517
D241,902 S * 10/1976 Corbo ..... D23/308
4,081,867 A * 4/1978 Simeola ..... A45D 19/04 4/516
4,196,478 A * 4/1980 Cowell ..... A45D 19/06 4/515

(Continued)

*Primary Examiner* — Benjamin R Shaw
(74) *Attorney, Agent, or Firm* — Kilpatrick Townsend & Stockton

(57) ABSTRACT

An apparatus for assisting hair washing is provided. The apparatus comprises: a bed portion; and a stand coupled with one end of the bed portion to incline the bed portion, the stand having a support portion to support a portion of a neck or a head of a person who is at least partially on the inclined bed portion and has at least a head portion suspended in the air for hair washing. The bed portion and the stand are configured to fit within a bath tub.

20 Claims, 14 Drawing Sheets

(56) References Cited

U.S. PATENT DOCUMENTS

| | | | | | |
|---|---|---|---|---|---|
| 4,754,503 | A * | 7/1988 | Martin | A45D 19/00 | 4/517 |
| 4,766,620 | A * | 8/1988 | Boyhan | A45D 19/00 | 4/516 |
| 5,548,853 | A * | 8/1996 | Johnson | A45D 19/10 | 4/523 |
| 5,722,100 | A * | 3/1998 | Jozwiak | A47D 15/008 | 4/572.1 |
| D425,245 | S * | 5/2000 | Davis | D28/20 | |
| 7,469,430 | B2 * | 12/2008 | Thies | A45D 19/04 | 4/516 |
| 7,874,024 | B1 * | 1/2011 | Singh | A45D 44/10 | 4/519 |
| 2014/0283293 | A1 * | 9/2014 | Staats | A45D 19/04 | 4/516 |

* cited by examiner

APPARATUS FOR ASSISTING HAIR WASHING

RELATED APPLICATION

This patent application claims priority to U.S. Provisional Patent Application Ser. No. 62/739,839, filed Oct. 1, 2018, entitled "Apparatus For Assisting Hair Washing," and which is assigned to the assignee hereof and is incorporated herein by reference in its entirety for all purposes.

BACKGROUND

Aspects of the disclosure relate to caregiver assistance devices, and more particularly to apparatuses for assisting hair washing.

To perform hair washing for a toddler at home (e.g., in a bathtub), typically a caregiver needs to bend over and hold the toddler in a sloping orientation with one hand, while using the other hand to wash the hair of the toddler. While such a maneuver can prevent the rinse water from running over the toddler's face and getting into the toddler's eyes, it is physically challenging and can cause injury to both the toddler and the caregiver. For example, the caregiver can easily lose balance and fall down together with the toddler, which can cause serious injury to both the toddler and the caregiver. Moreover, as the caregiver bends over to support the weight of the toddler, the bend-over posture puts significant strains on the back of the caregiver and can cause back injury.

SUMMARY

The present disclosure relates to caregiver assistance devices. More specifically, and without limitation, this disclosure relates to an apparatus for assisting hair washing, which can be used by a caregiver to perform hair washing for a toddler.

In one example, an apparatus for assisting hair washing is provided. The apparatus comprises a bed portion and a stand coupled with one end of the bed portion, the stand forming a standing structure with the bed portion on a surface, the bed portion in the standing structure being inclined with respect to the surface, the stand having a support portion to support a neck or a first portion of a head of a person who is at least partially on the inclined bed portion and who has at least a second portion of the head suspended in the air for hair washing. The bed portion and the stand are configured to fit within a bath tub.

In one aspect, the support portion has a U-shaped depression to further prevent the person's head from rolling along the one end of the bed portion.

In one aspect, the stand comprises a plane having a U-shaped valley.

In one aspect, a lowest point of the U-shaped depression is adjustable.

In one aspect, the stand comprises a chamber and a plate slidably fit within the chamber to move up or down to adjust the lowest point of the U-shaped depression.

In one aspect, the bed portion comprises a surface for the person to lie on.

In one aspect, the surface is covered with a soft material.

In one aspect, the surface includes a set of anti-slip strips configured to prevent the person from slipping down the inclined bed portion.

In one aspect, the bed portion comprises a depression region to restrict a movement of the person on the bed portion.

In one aspect, the bed portion comprises a set of straps configured to prevent the person from slipping down the inclined bed portion.

In one aspect, the stand is detachably coupled with the one end of the bed portion.

In one aspect, the stand comprises a set of grooves, each of the set of grooves configured to receive the one end of the bed portion. The set of grooves enables setting a range of an angle of inclination of the bed portion.

In one aspect, the set of grooves and the one end of the bed portion comprise a magnetic material to detachably couple the one end of the bed portion with the stand.

In one aspect, the one end of the bed portion is coupled with the stand via a hinge which is lockable to maintain an angle of inclination of the bed portion with respect to the surface when the hinge is locked and to allow the bed portion to fold against the stand when the hinge is unlocked.

In one aspect, at least one of the stand or the bed portion comprises one or more suction cups configured to attach the at least one of the stand or the bed portion to the surface.

In one aspect, the one or more suction cups of the stand are configured to attach the stand to a wall of the bath tub.

In one aspect, the stand and the bed portion are configured to stand on a platform adjacent to a sink to allow the person's head to be suspended over the sink for hair washing.

In one aspect, the platform comprises a chair or a table.

In one aspect, the stand and the bed portion are made of a material comprising at least one: wood, plastic, metal, or cardboard.

In one aspect, the bed portion is configured to support the person's back or belly.

BRIEF DESCRIPTION OF DRAWINGS

Non-limiting and non-exhaustive aspects are described with reference to the following figures, wherein like reference numerals refer to like parts throughout the various figures unless otherwise specified.

DETAILED DESCRIPTION

Several illustrative examples will now be described with respect to the accompanying drawings, which form a part hereof. While particular examples, in which one or more aspects of the disclosure may be implemented, are described below, other examples may be used and various modifications may be made without departing from the scope of the disclosure or the spirit of the appended claims.

Washing hair for a young toddler can be physically challenging and can cause injury to both the caregiver and the toddler. As described above, typically a caregiver bends over and holds the toddler in a sloping orientation with one hand and use the other hand to wash the hair of the toddler. With such a posture, the caregiver can easily lose balance and fall. Hair washing becomes even more physically challenging and risky when the toddler is in a bathtub in a bathroom. The bathtub may have thick walls, and the caregiver needs to bend over the thick bathtub wall to hold the toddler. The thick bathtub wall further separates the caregiver from the toddler and, in combination with the slippery bathroom floor, which makes it even harder for the caregiver to maintain balance when bending over to support the toddler, which increases the risks of fall and injury.

Disclosed are techniques and apparatuses to assist hair washing. In one example, an apparatus comprises a bed portion, and a stand coupled with one end of the bed portion to incline the bed portion, the stand having a support portion to support a neck portion of a person who is on the inclined bed portion and has at least a head portion suspended in the air for hair washing. The bed portion and the stand are configured to fit within a bath tub.

The disclosed techniques can reduce the workload of a caregiver when performing hair washing for a toddler, and can reduce the injury risks of both the caregiver and the toddler. For example, the bed portion and the stand can be positioned within a bath tub. The toddler can lie on the inclined bed portion in a sloping orientation and have his or her neck supported by the support portion of the stand. The bed portion may include mechanisms (e.g., straps) to prevent the toddler from slipping down the bed portion. As a result, the caregiver needs not bend over to support the weight of the toddler (although the caregiver may still need to bend over to perform the hair washing), the strains on the back of the caregiver can be reduced, and the risk of spine injury and fall can also be reduced. As a result, the caregiver can perform hair washing for the toddler in a safe manner.

Figure 1:
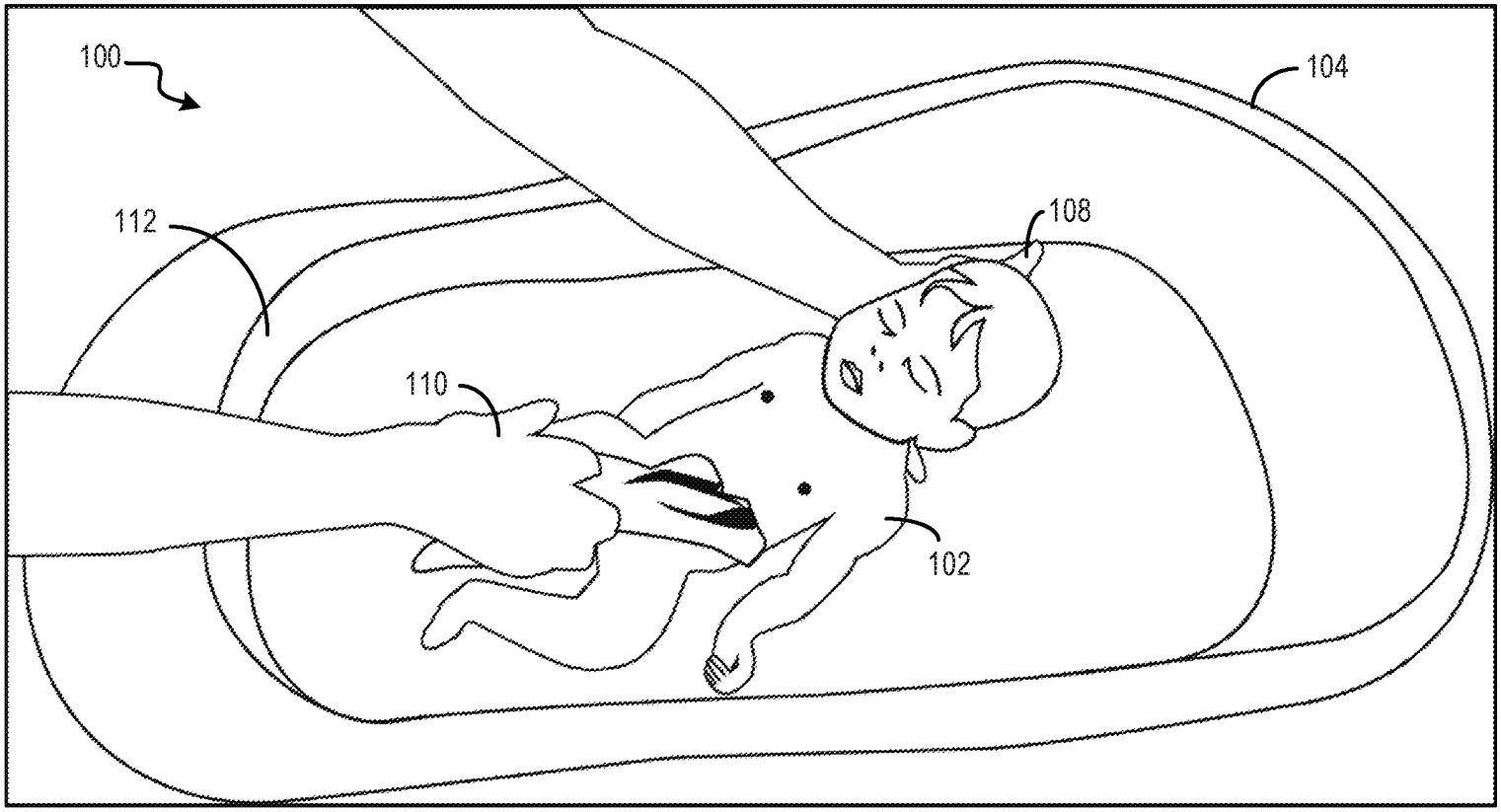
FIG. 1 illustrates an environment in which the disclosed techniques can be used.

FIG. 1 illustrates an environment 100 in which the disclosed techniques can be used. As shown in FIG. 1, to perform hair washing for a toddler 102 in a bathtub 104, a caregiver can hold toddler 102 in a sloping orientation with one hand 108, and perform hair washing for toddler 102 with the other hand 110. The caregiver can hold toddler 102 at the back of the head, at the neck portion, etc., with hand 108 to support the weight of toddler 102. To hold toddler 102 in bathtub 104 which is on the ground, the caregiver needs to bend over. If toddler 102 is heavy, the caregiver may even need to bend over bath tub wall 112 to maintain balance. The bend-over posture puts significant strains on the spine of the caregiver, which may result in spine injury. Moreover, the caregiver can also easily lose balance and fall into bathtub 104 with toddler 102, which can result in severe injury to both the caregiver and toddler 102.

Figure 2:
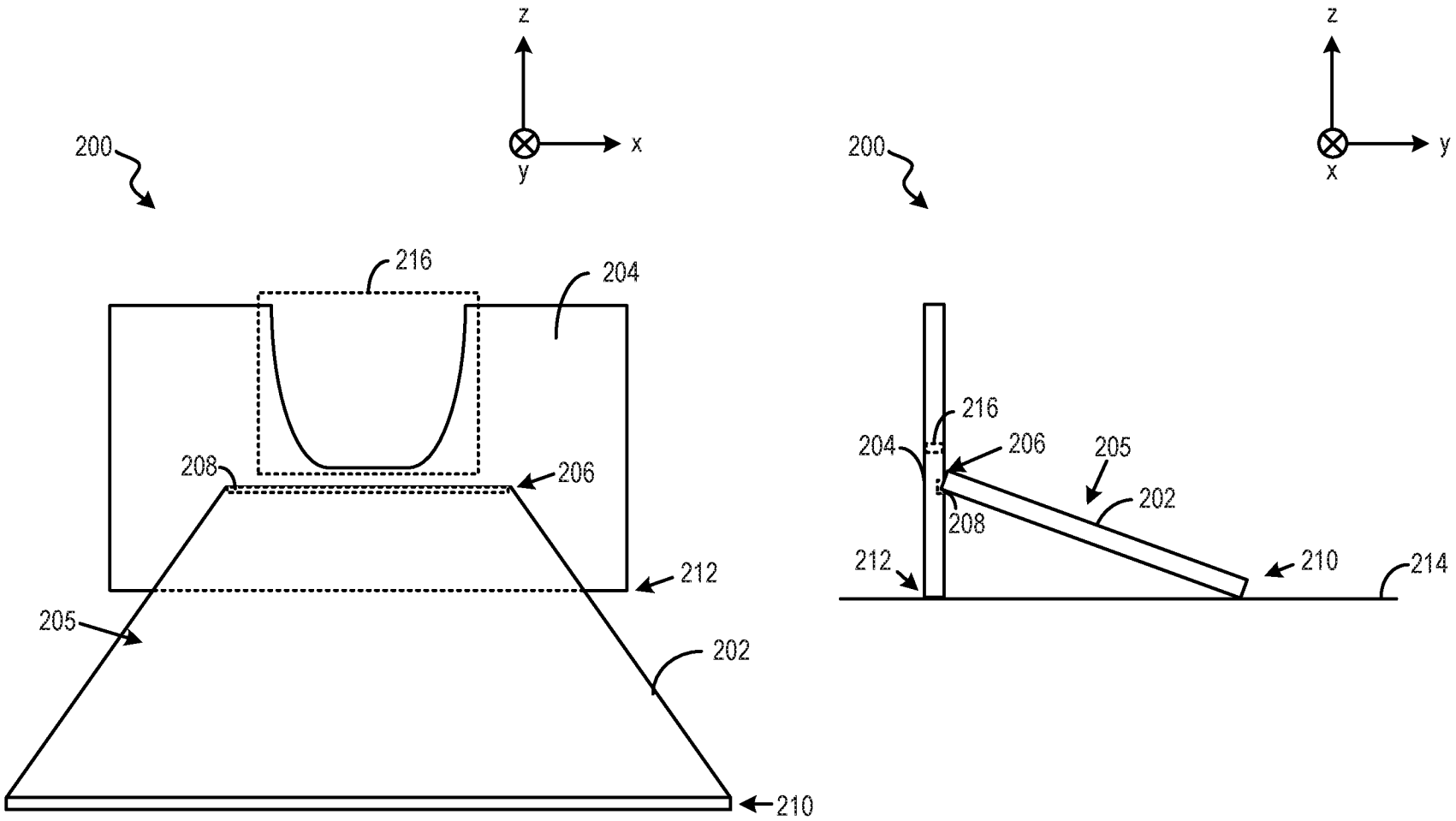
FIG. 2 illustrates a simplified diagram of an example assistance device, according to certain aspects of the present disclosure.

FIG. 2 illustrates an example of an assistance apparatus 200 according to certain aspects of the disclosure. FIG. 2 illustrates a front view (e.g., facing the X and Z axes) and a side view (e.g., facing the Y and Z axes) of assistance apparatus 200. As shown in FIG. 2, assistance apparatus 200 includes a bed portion 202 and a stand 204. Bed portion 202 provides a surface 205 for a person (e.g., a toddler) to lie on and can provide support for at least part of the back of the person. Stand 204 can be coupled with one end 206 of bed portion 202. For example, stand 204 may include a groove 208 to receive end 206 of bed portion 202. The other end 210 of bed portion 202, together with end 212 of stand 204, can touch surface 214 which is parallel with the X-Y plane. Stand 204 and bed portion 202 can form a standing structure which can stand on its own on surface 214. The standing structure can have bed portion 202 inclined relative to surface 214, which allows the person lying on surface 205 of bed portion 202 to have his or her head (and hair) suspended over surface 214 for hair washing. In some embodiments, surface 205 can be covered with soft or elastic water-proof materials (e.g., rubber) to improve comfort.

In addition, stand 204 further includes a support portion 216 to support the neck and/or the head of the person lying on bed portion 202. In some embodiments, as shown in FIG. 2, support portion 216 may include a U-shaped depression that can partially enclose the neck and/or the head of person. The U-shaped depression can be configured to prevent, for example, a toddler lying on bed portion 202 from moving his/her head sideway with respect to bed portion 202 (e.g., along the X-axis) when the caregiver washes the toddler's hair. The U-shaped depression can also be configured to provide additional support to the neck and/or the head of the person. In some embodiments, the edge of the U-shaped depression can be lined with soft or elastic water-proof materials (e.g., rubber) to improve comfort.

Bed portion 202 and stand 204 can be made of various materials, such as wood, plastic, metal, cardboard, etc., or any other materials having sufficient strength to support a threshold weight which can be application-specific. In some embodiments, bed portion 202 and stand 204 can be covered with water-proof coatings.

Figure 3A:
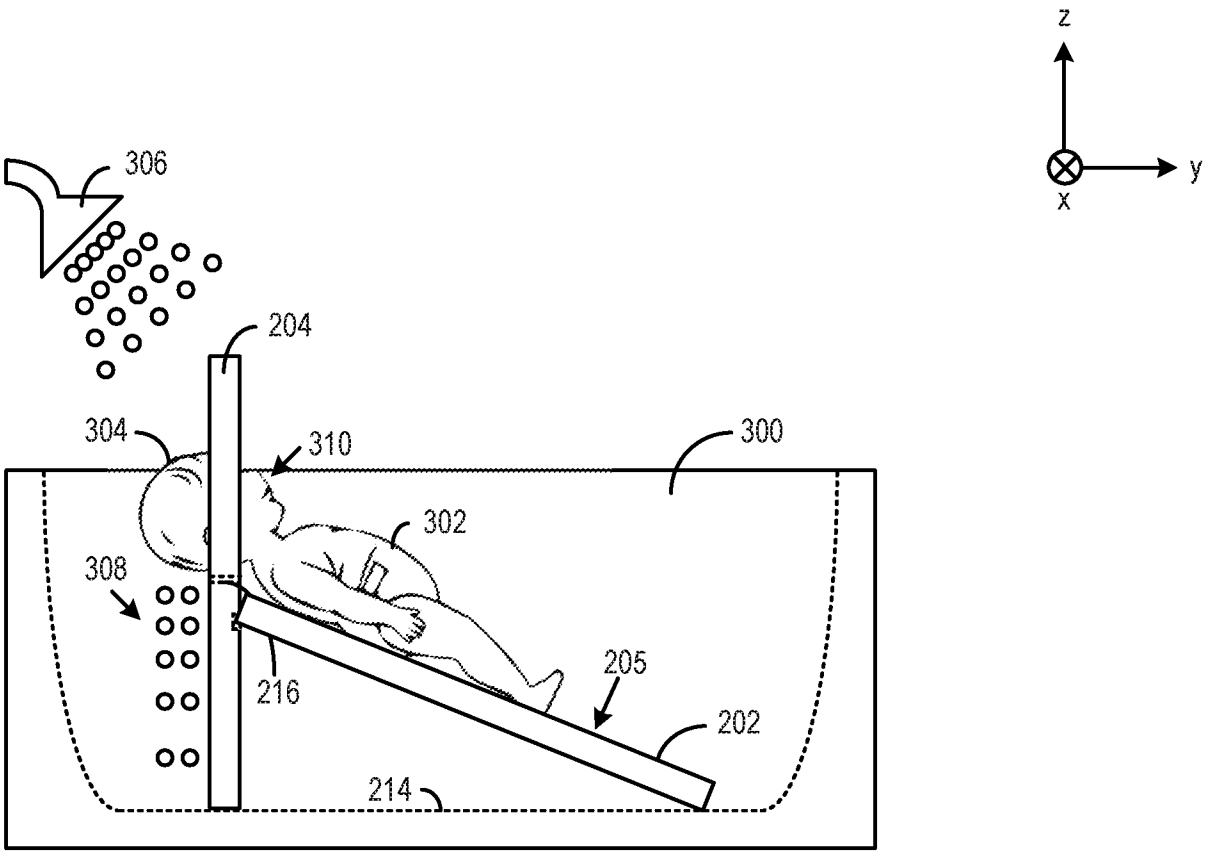
FIG. 3A, FIG. 3B, and FIG. 3C illustrate example operation environments of the assistance device of FIG. 2.
Figure 3B:
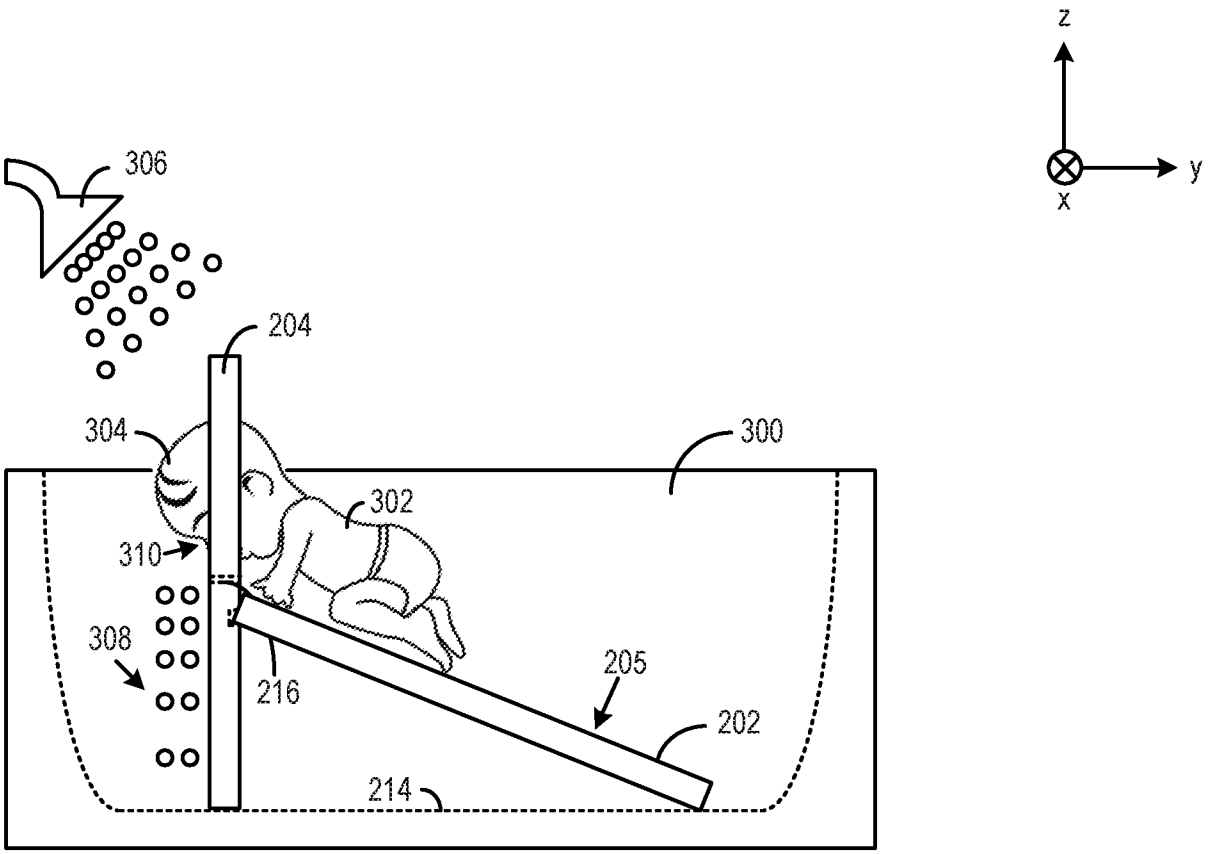

Assistance apparatus 200 can be adapted to operate in different environments and can be used to assist hair washing for persons of different sizes. FIG. 3A and FIG. 3B illustrate examples of applications of assistance apparatus 200. As shown in FIG. 3A, assistance apparatus 200 can be placed in a bathtub 300 and can stand on surface 214 of bathtub 300. A toddler 302 can lie on inclined bed portion 202 and can have his/her upper and lower body supported by surface 205. Part of head 304 of toddler 302 can be supported by support portion 216 of stand 204, which allows at least part of head 304 to suspend in the air over surface 214 for hair washing. Support portion 216 can also prevent head 304 of toddler 302 from moving sideway with respect to bed portion 202 and stand 204 (e.g., along the X axis). Head 304 may receive water from shower head 306, and rinse water 308 can flow vertically downwards along the Z axis and away from face 310 of toddler 302. With assistance apparatus 200, toddler 302 can be kept a sloping orientation (to avoid rinse water 308 flowing over face 310) in bathtub 300 on his/her own and without receiving physical support from the caregiver, which can significantly improve the safety of hair washing for both the toddler and the caregiver.

Although FIG. 3A illustrates that assistance apparatus 200 maintains toddler 302 in a sloping orientation for hair washing, it is understood that assistance apparatus 200 can also assists in maintaining toddler 302 in a different posture/orientation to facilitate hair washing. As shown in FIG. 3B, toddler 302 can also lie on his/her belly on inclined bed portion 202 with face 310 facing downwards. Part of face 310 can be supported by support portion 216, and at least part of head 304 can be suspended in the air over surface 214. With this posture, as shown in FIG. 3B, rinse water 308 can also fall vertically downwards along the Z axis and can stay away from face 310 of toddler 302.

Figure 3C:
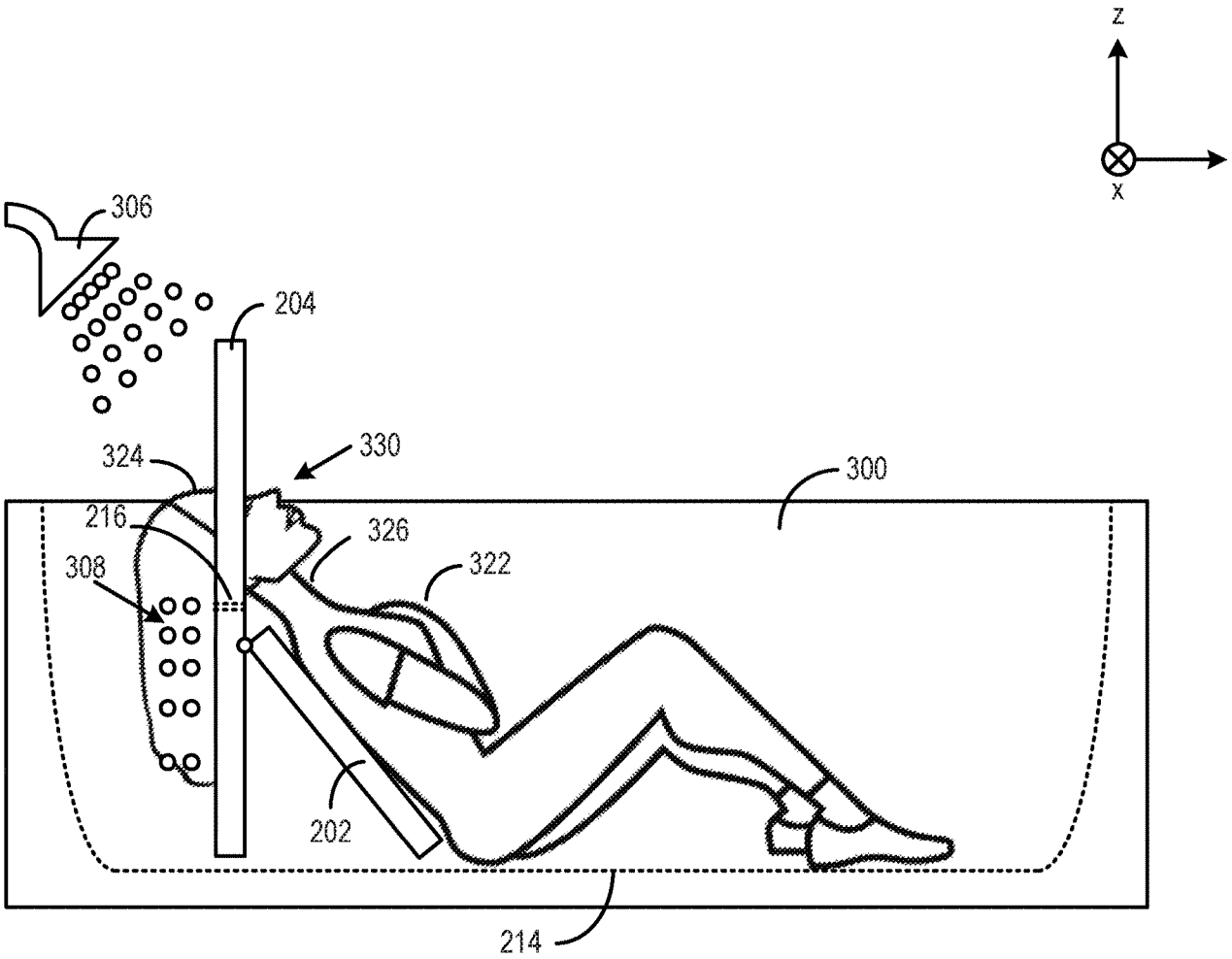

Although FIG. 3A and FIG. 3B illustrate that assistance apparatus 200 is used for washing the hair of a toddler, it is understood that assistance apparatus 200 can also be used for washing the hair of people of different sizes, including young child and adults, in bathtub 300. FIG. 3C illustrates an example where assistance apparatus 200 can be used for washing hair of a young child 322. As shown in FIG. 3C, young child 322 can sit on surface 214 and has his/her back on inclined bed portion 202 to maintain a sloping orientation. Head 324 of young child 322 can be suspended in the air over surface 214, whereas neck 326 of young child 322 can be supported by support portion 216 of stand 204, which allows rinse water 308 to flow vertically and downwards along the Z axis and away from face 330 of young child 322.

Figure 4A:
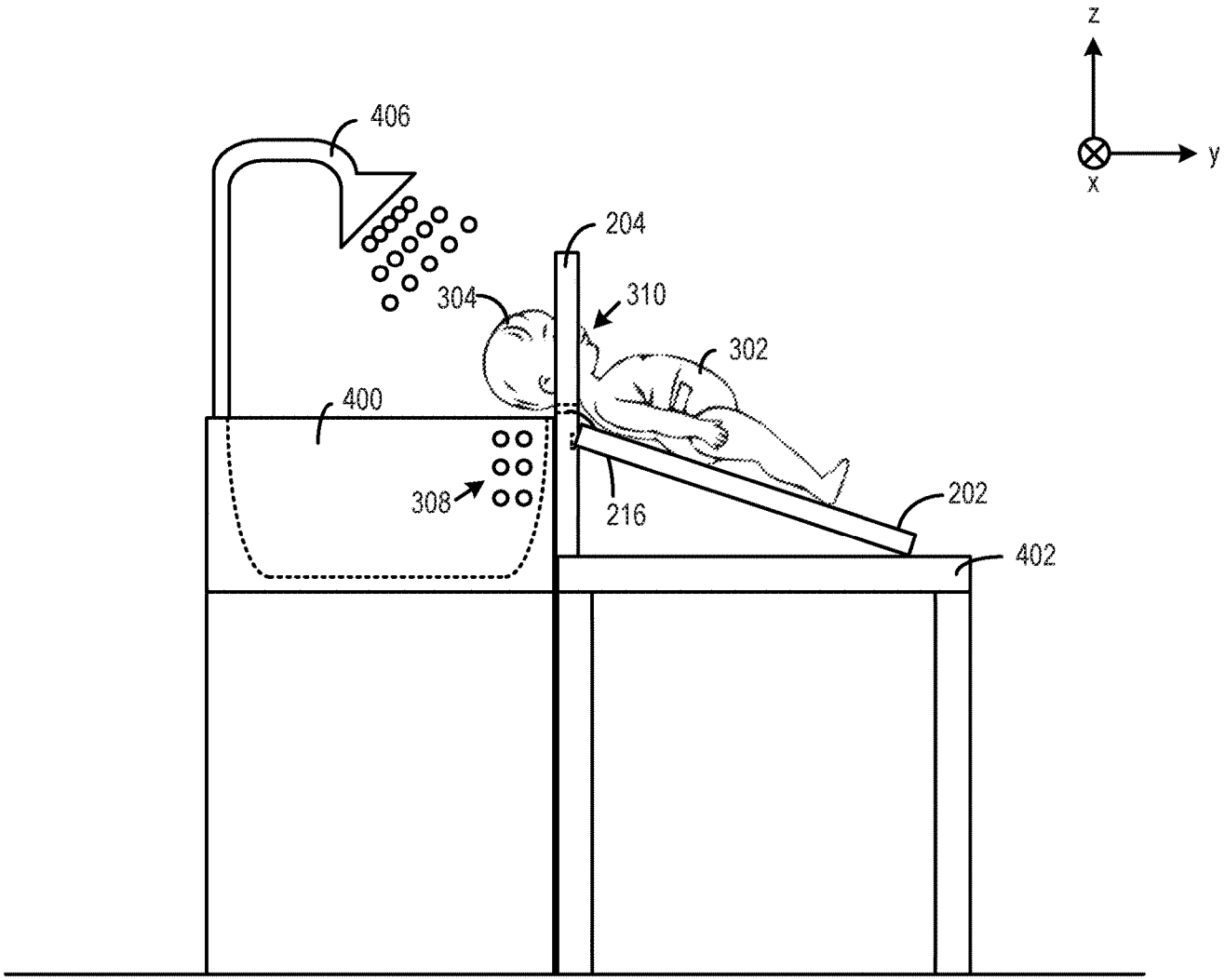
FIG. 4A and FIG. 4B illustrate example operation environments of the assistance device of FIG. 2.
Figure 4B:
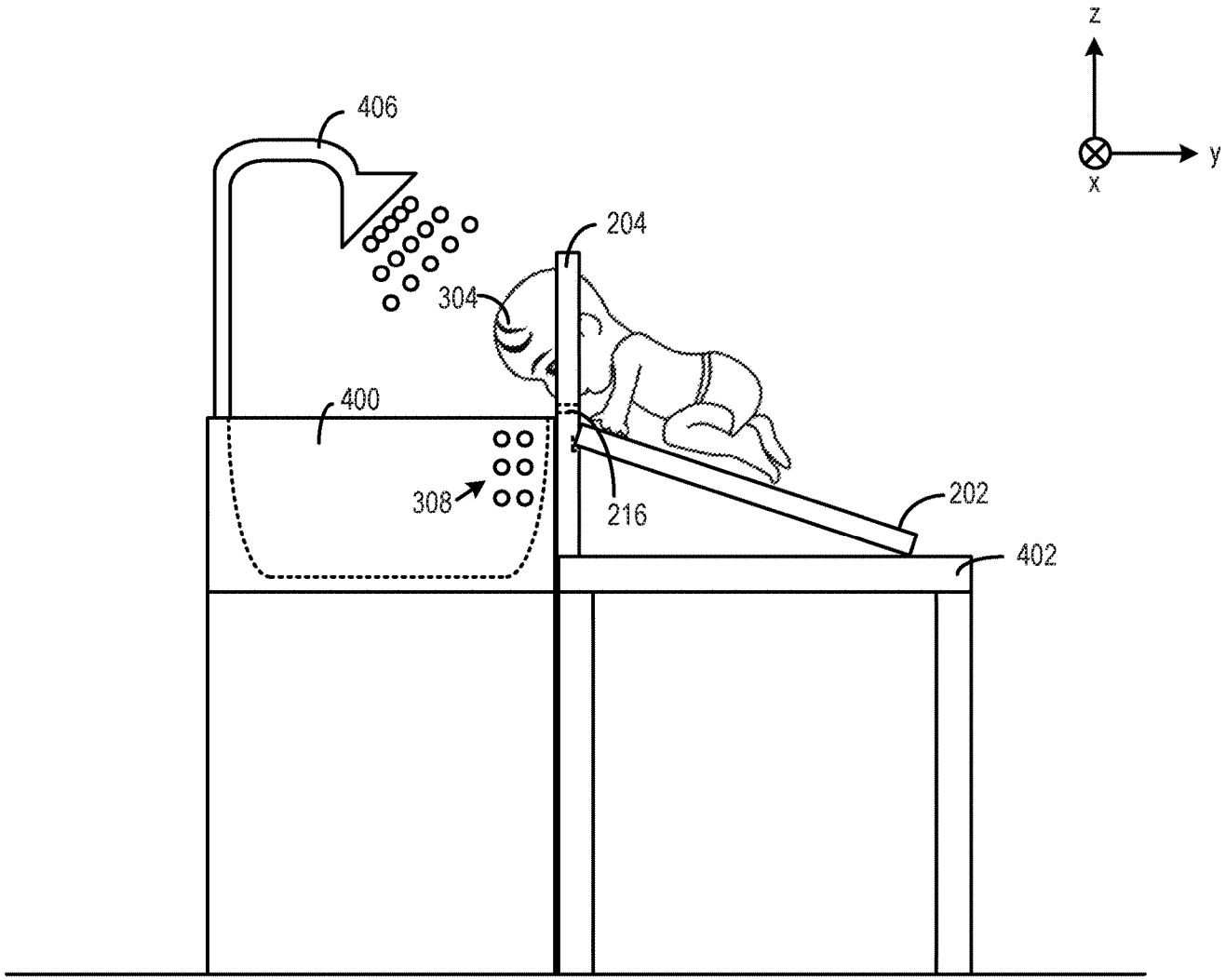

In addition to providing assistance for hair washing in a bathtub, assistance apparatus 200 can also be adapted/used to assist hair washing in other environments, such as hair washing using a sink (e.g., a bathroom sink, a kitchen sink, etc.). FIG. 4A and FIG. 4B illustrate examples where assistance apparatus 200 can be used for hair washing in a sink 400. As shown in FIG. 4A, assistance apparatus 200 can stand on a platform 402 adjacent to sink 400. Platform 402 can be part of a chair, a table, etc. Toddler 302 can lie on inclined bed portion 202 and can have his/her upper and lower body supported by surface 205. Part of head 304 of toddler 302 can be supported by support portion 216 of stand 204, which allows at least part of head 304 to suspend over sink 400. Head 304 may receive water from faucet 406, and rinse water 308 can flow vertically and downwards along the Z axis into sink 400 and away from face 310 of toddler 302. Moreover, as shown in FIG. 4B, toddler 302 can also lie on his/her belly on inclined bed portion 202 with face 310 facing downwards. Part of face 310 can be supported by support portion 216, and at least part of head 304 can suspended over sink 400, to allow rinse water 308 to flow vertically and downwards along the Z axis into sink 400 and away from face 310 of toddler 302.

Figure 5A:
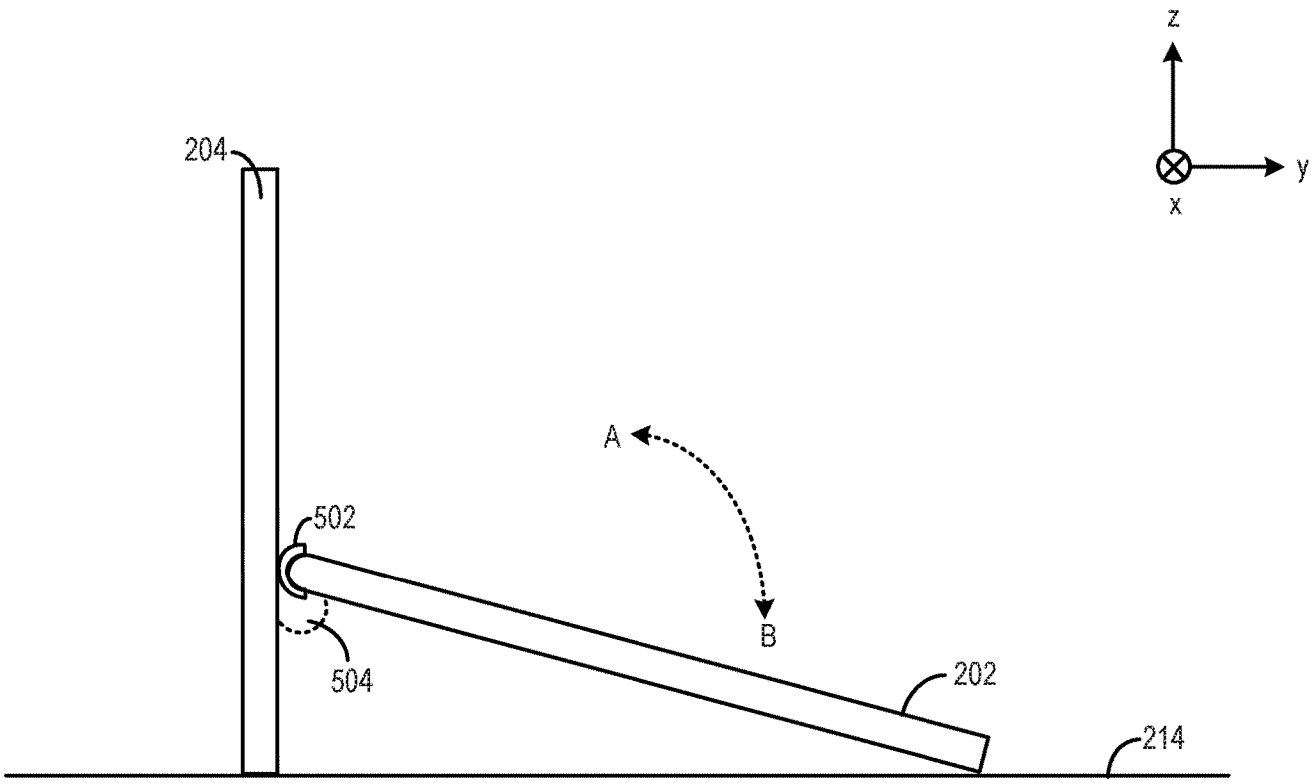
FIG. 5A and FIG. 5B illustrate other examples of assistance device, according to certain aspects of the present disclosure.

In some embodiments, assistance apparatus 200 can also be adapted to facilitate storage when the apparatus is not used for hair washing. For example, as shown in FIG. 5A, assistance apparatus 200 may include one or more hinges 502 configured to couple end 206 of bed portion 202 with stand 204. Hinges 502 can be lockable. When assistance apparatus 200 is used for hair washing, hinges 502 can be locked to maintain an angle 504 between bed portion 202 with stand 204 to enable assistance apparatus 200 to stand on surface 214 and to provide physical support to a person on inclined bed portion 202. When assistance apparatus 200 is not used, hinges 502 can be unlocked, which allows bed portion 202 to rotate around hinges 502 towards stand 204 (along direction A or direction B of FIG. 5A) to fold up assistance apparatus 200 for storage.

Figure 5B:
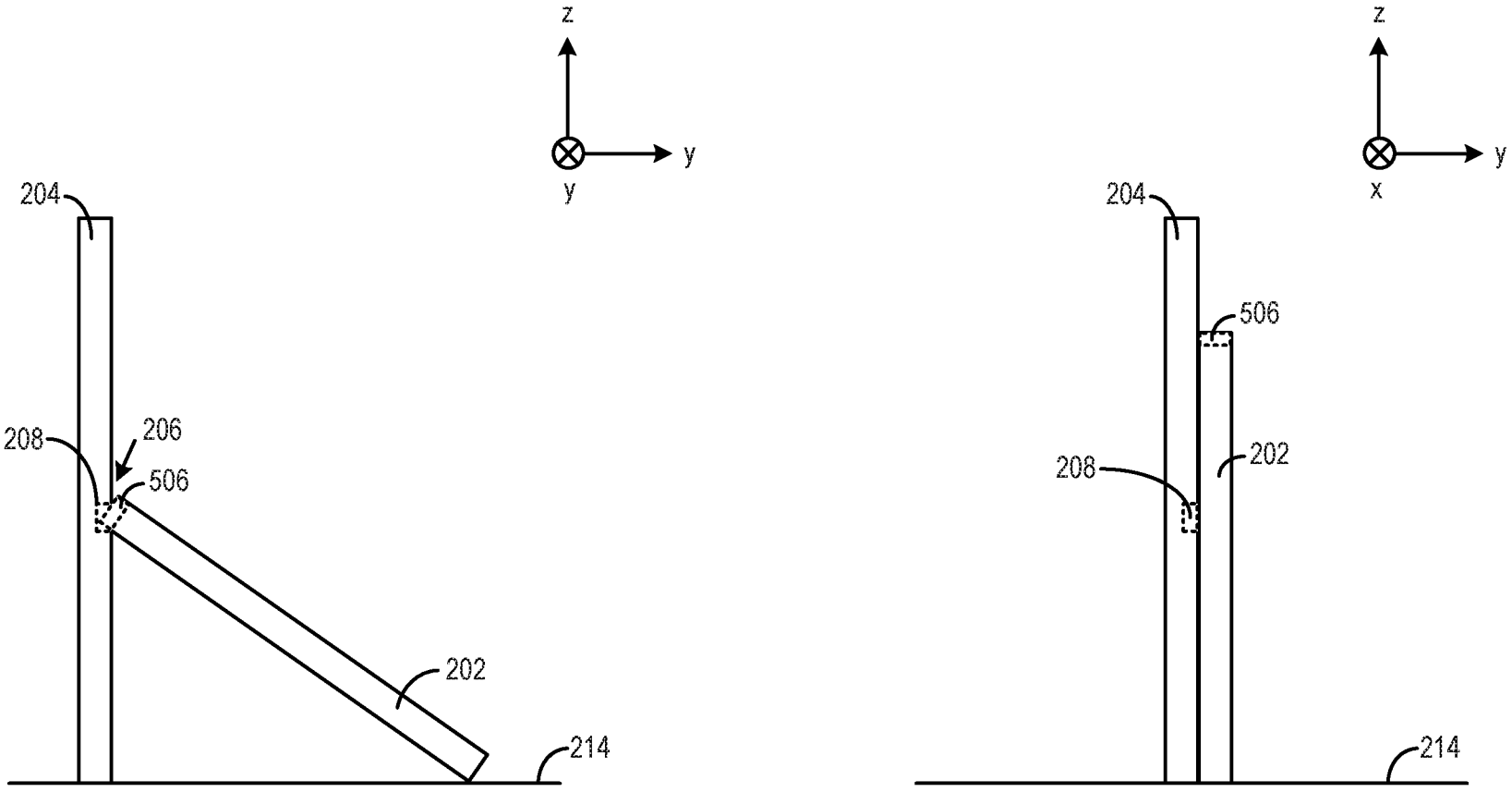

As another example, as shown in FIG. 5B, bed portion 202 can be detachable from stand 204 to facilitate storage. For example, end 206 of bed portion 202 may a magnet 506, whereas groove 208 of stand 204 can be lined with a magnetic metal 508 (or vice versa). When assistance apparatus 200 is used for hair washing, end 206 can be coupled with groove 208 via magnetic force to allow bed portion 202 and stand 204 to form a standing structure. When assistance apparatus 200 is not used, bed portion 202 and stand 204 can be detached from each other, and can be stacked sideway (as shown in FIG. 5B) or stacked vertically to reduce the space required for storage.

In some embodiments, the inclination of bed portion 202 can be adjustable. The adjustability of inclination of bed portion 202 can further improve the operational flexibility of assistance apparatus 200 such that it can be more easily adapted to different operation environments. For example, referring back to the example applications of assistance apparatus 200 in FIG. 3A and FIG. 3B, bed portion 202 can be configured to have a smaller inclination with respect to surface 214 when bed portion 202 supports the entire body (except the neck and head) of toddler 302. Such arrangements allow toddler 302 to stay on bed portion 202 and make it less likely that toddler 302 slips down bed portion 202. On the other hand, referring to FIG. 3C, bed portion 202 can be configured to have a larger inclination with respect to surface 214 when bed portion 202 only provides back support for a person sitting on surface 214, to allow the person to sit in a slightly more up-right (but still sloped) position to improve better ergonomics, and to enable the person to get up more easily when hair washing completes.

Figure 6:
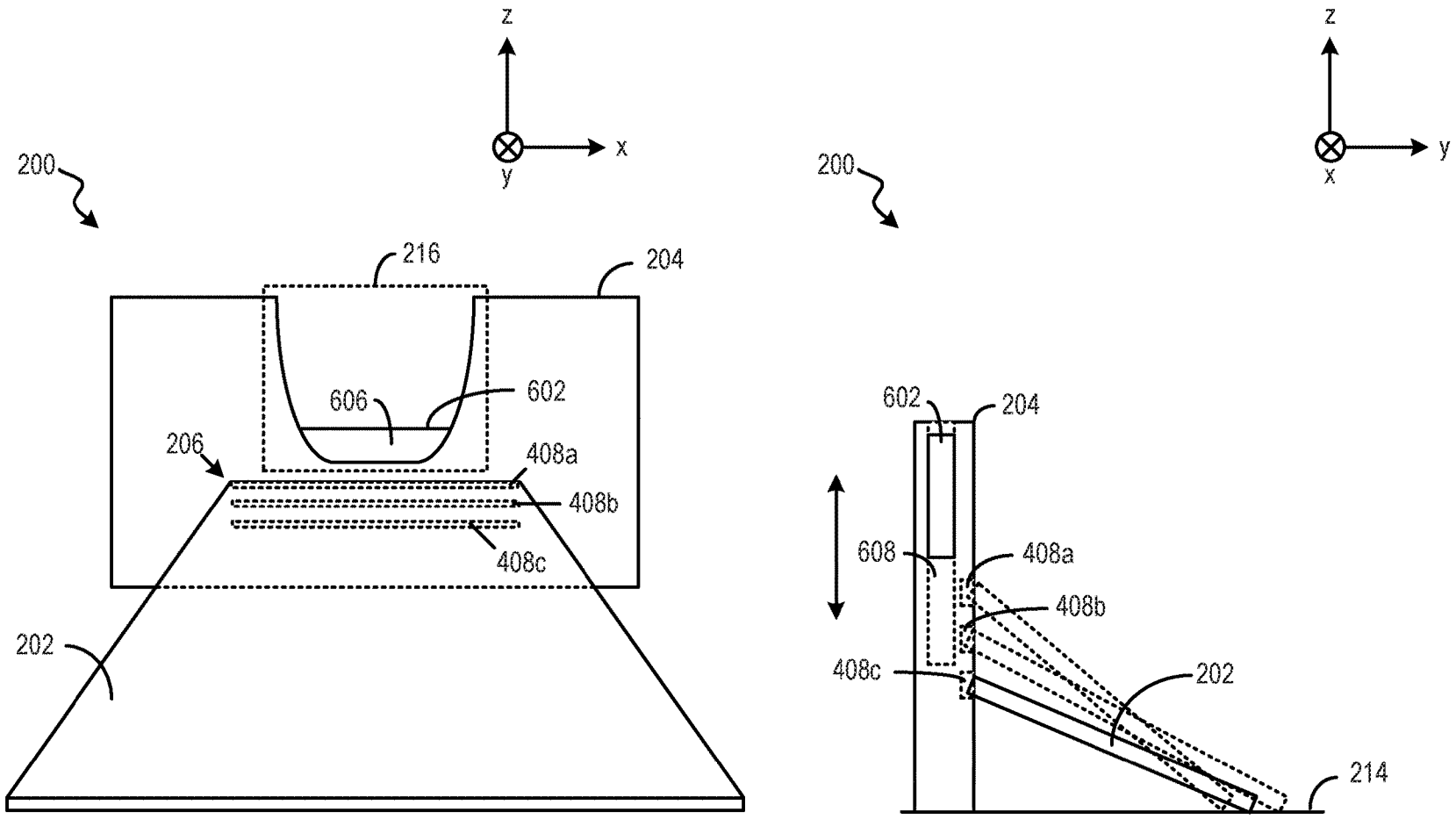
FIG. 6, FIG. 7, FIG. 8, FIG. 9, and FIG. 10 illustrate other examples of assistance device, according to certain aspects of the present disclosure.

FIG. 6 illustrates an example of assistance apparatus 200 for which the inclination of bed portion is adjustable according to certain aspects of the disclosure. As shown in FIG. 6, stand 204 may include multiple grooves 408*a*, 408*b*, 408*c*, etc. End 206 of bed portion 202 can attach to (or detach from) any one of grooves 408*a*, 408*b*, or 408*c* to adjust the inclination of bed portion 202. For example, grooves 408*a*, 408*b*, and 408*c* may be lined a magnetic metal 508, whereas end 206 may include a magnet 506 (or vice versa), which allows end 206 to be magnetically coupled with one of grooves 408*a*, 408*b*, and 408*c*.

In some embodiments, the lowest edge 602 of support portion 216 can also be adjustable to match the elevation of end 206 (with respect to surface 214 along the Z axis) to provide neck/head support. For example, support portion 216 may include a plate 606 slidably fit within a chamber 608 within stand 204, and plate 606 that can slide up or down (along the Z direction) within the chamber to set the elevation of edge 602. When end 206 of bed portion 202 is fit into groove 408*a* to have maximum elevation, plate 606 can slide up to increase the elevation of edge 602. When end 206 of bed portion 202 is fit into groove 408*c* to have minimum elevation with respect to surface 214, plate 606 can slide down to reduce the elevation of edge 602.

Figure 7:
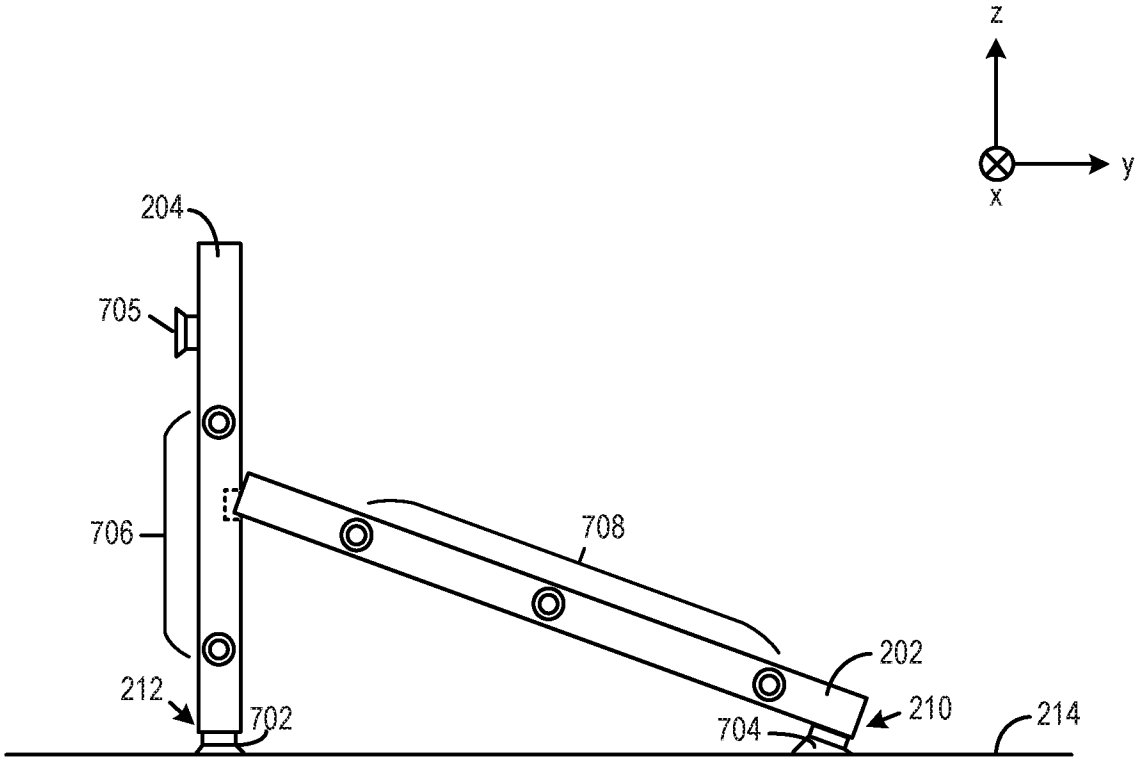

In some embodiments, assistance apparatus 200 may include additional mechanisms to improve the stability of the standing structure formed by stand 204 and bed portion 202. One way to improve the stability of the standing structure can be based on improving the attachment of stand 204 and bed portion 202 to surface 214 and to other surfaces (e.g., a bathtub wall). To improve the attachment, at least one of stand 204 or bed portion 202 can include a plurality of air suction cups. For example, as shown in FIG. 7, stand 204 can include one or more air suction cups 702 at end 212, whereas bed portion 202 can include one or more air suction cups 704 at end 210, to improve attachment of stand 204 and bed portion 202 to surface 214. In addition, stand 204 and bed portion 202 may include air suction cups on the side surfaces (parallel with the Y-Z plane) including, for example, air suction cups 705, 706 and 708 for attachment to a wall (e.g., a bathtub wall), to further improve the stability of the standing structure. In some examples, instead of or in addition to air suction cups, stand 204 may include snaps or hooks to connect with a wall of the kitchen sink to improve mechanical support of stand 204.

Figure 8:
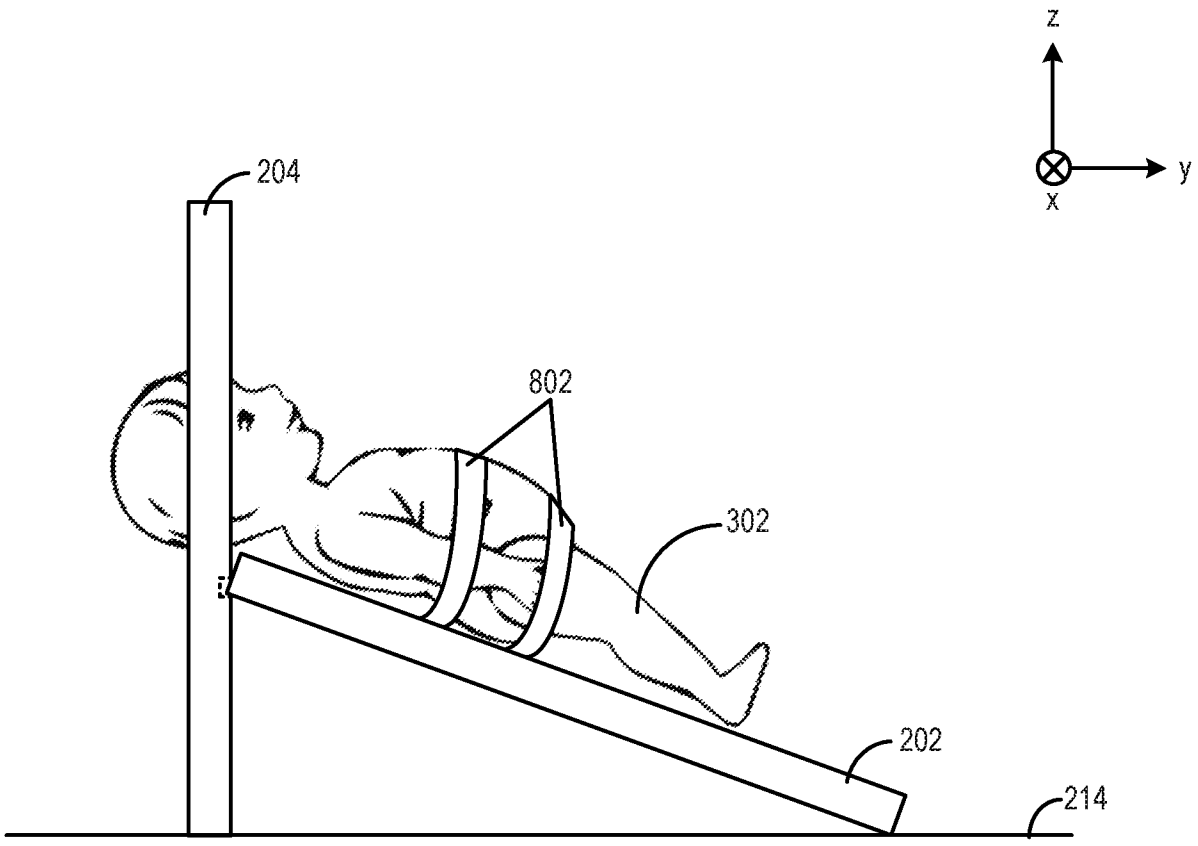
Figure 9:
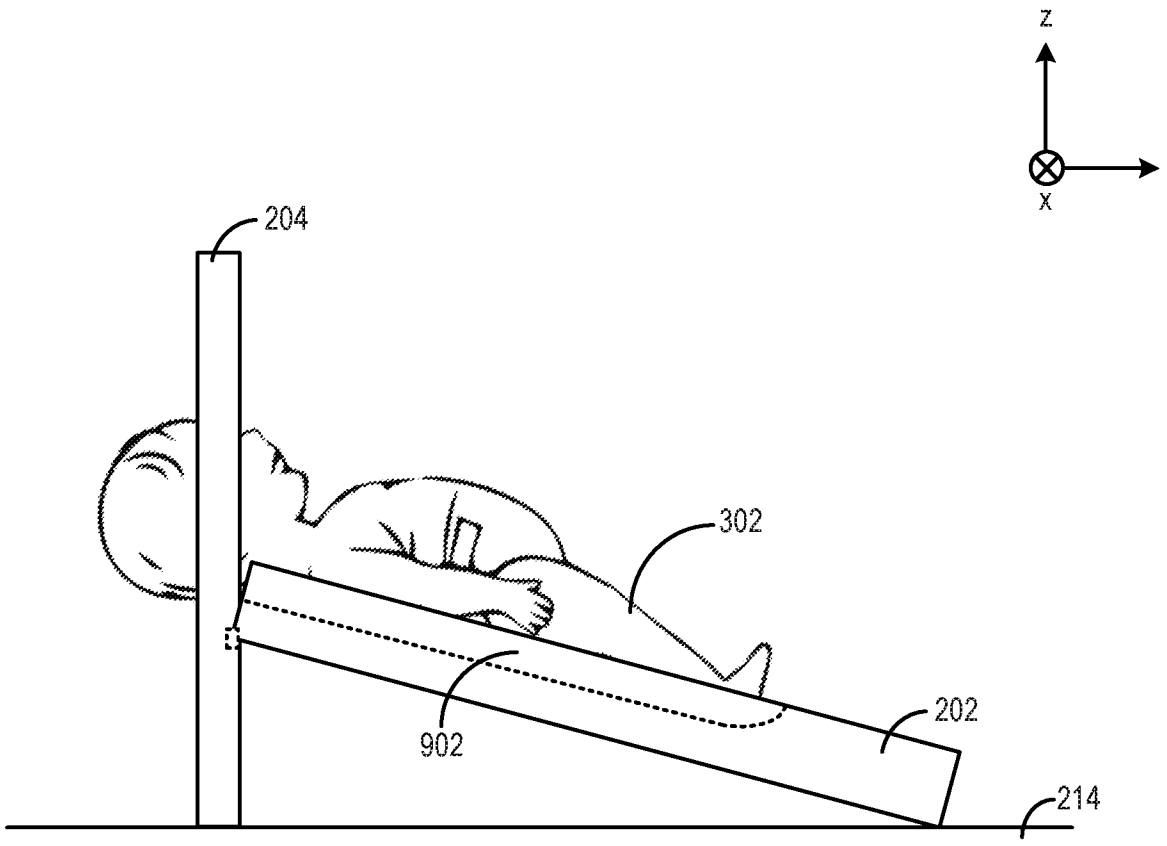
Figure 10:
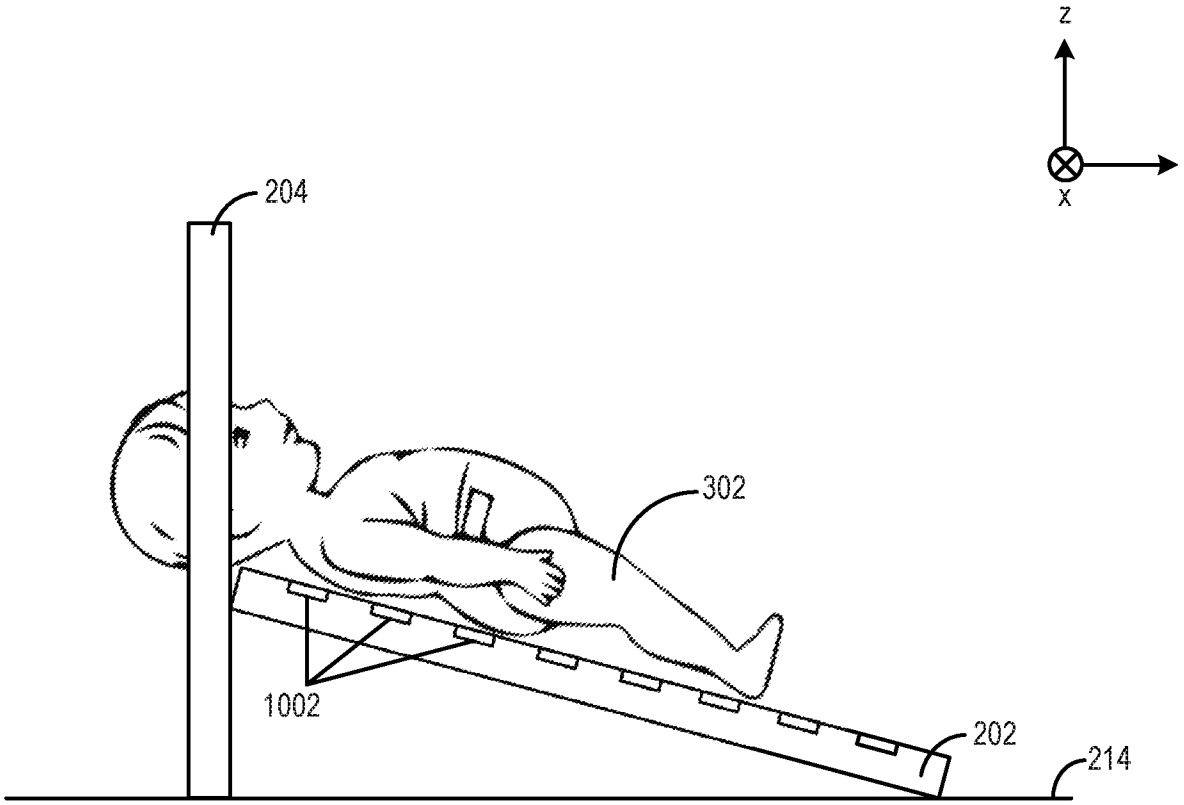

In some embodiments, assistance apparatus 200 may include additional mechanisms to reduce the likelihood of a person (e.g., toddler 302) falling off inclined bed portion 202 by, for example, rolling sideways (along the X axis) and/or slipping down inclined bed portion 202. For example, as shown in FIG. 8, bed portion 202 may include one or more straps 802 that can restraint the movement of toddler 302 on bed portion 202 and to prevent toddler 302 from rolling sideways or slipping/sliding down inclined bed portion 202. As another example, as shown in FIG. 9, bed portion 202 can include a depression region 902 which can partially enclose toddler 302 to restrict the movement of the toddler on bed portion 202. As another example, as shown in FIG. 10, bed portion 202 can include a set of anti-slip strips 1002 that can increase the friction between bed portion 202 and toddler 302 to prevent toddler 302 from slipping/sliding down inclined bed portion 202.

The techniques and apparatuses discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

The invention claimed is:

1. An apparatus for assisting hair washing, comprising:

a bed portion; and a stand coupled with one end of the bed portion and forms a standing structure with the bed portion on a surface, the bed portion in the standing structure being inclined with respect to the surface, the stand having a support portion to support a neck or a first portion of a head of a person who is at least partially on the inclined bed portion and who has at least a second portion of the head suspended in the air for hair washing, wherein the bed portion and the stand are configured to fit within a bath tub; and wherein the support portion has a U-shaped depression to prevent the head of the person from rolling along the one end of the bed portion, a lowest point of the U-shaped depression being adjustable.

2. The apparatus of claim 1, wherein the stand comprises a plane having a U-shaped valley.

3. The apparatus of claim 1, wherein the stand comprises a chamber and a plate slidably fit within the chamber to move up or down to adjust the lowest point of the U-shaped depression.

4. The apparatus of claim 1, wherein the bed portion comprises a surface for the person to lie on.

5. The apparatus of claim 4, wherein the surface is covered with a soft material.

6. The apparatus of claim 4, wherein the surface includes a set of anti-slip strips configured to prevent the person from slipping down the inclined bed portion.

7. The apparatus of claim 1, wherein the bed portion comprises a depression region to restrict a movement of the person on the bed portion.

8. The apparatus of claim 1, wherein the bed portion comprises a set of straps configured to prevent the person from slipping down the inclined bed portion.

9. The apparatus of claim 1, wherein the stand is detachably coupled with the one end of the bed portion.

10. The apparatus of claim 9, wherein the stand comprises a set of grooves, each of the set of grooves configured to receive the one end of the bed portion; and wherein the set of grooves enables setting a range of an angle of inclination of the bed portion.

11. The apparatus of claim 10, wherein the set of grooves and the one end of the bed portion comprise a magnetic material to detachably couple the one end of the bed portion with the stand.

12. The apparatus of claim 1, wherein the one end of the bed portion is coupled with the stand via a hinge which is lockable to maintain an angle of inclination of the bed portion with respect to the surface when the hinge is locked and to allow the bed portion to fold against the stand when the hinge is unlocked.

13. The apparatus of claim 1, wherein at least one of the stand or the bed portion comprises one or more suction cups configured to attach the at least one of the stand or the bed portion to the surface.

14. The apparatus of claim 13, wherein the one or more suction cups of the stand are configured to attach the stand to a wall of the bath tub.

15. The apparatus of claim 1, wherein the stand and the bed portion are configured to stand on a platform adjacent to a sink to allow the head of the person to be suspended over the sink for hair washing.

16. The apparatus of claim 15, wherein the platform comprises a chair or a table.

17. The apparatus of claim 1, wherein the stand and the bed portion are made of a material comprising at least one: wood, plastic, metal, or cardboard.

18. The apparatus of claim 1, wherein the bed portion is configured to support the person's back or belly.

19. An apparatus for assisting hair washing, comprising:

a bed portion; and a stand coupled with one end of the bed portion and forms a standing structure with the bed portion on a surface, the bed portion in the standing structure being inclined with respect to the surface, the stand having a support portion to support a neck or a first portion of a head of a person who is at least partially on the inclined bed portion and who has at least a second portion of the head suspended in the air for hair washing, wherein the bed portion and the stand are configured to fit within a bath tub;

wherein the stand is detachably coupled with the one end of the bed portion;

wherein the stand comprises a set of grooves, each of the set of grooves configured to receive the one end of the bed portion; and wherein the set of grooves enables setting a range of an angle of inclination of the bed portion.

20. An apparatus for assisting hair washing, comprising:

a bed portion; and a stand coupled with one end of the bed portion and forms a standing structure with the bed portion on a surface, the bed portion in the standing structure being inclined with respect to the surface, the stand having a support portion to support a neck or a first portion of a head of a person who is at least partially on the inclined bed portion and who has at least a second portion of the head suspended in the air for hair washing, wherein the bed portion and the stand are configured to fit within a bath tub; and wherein the one end of the bed portion is coupled with the stand via a hinge which is lockable to maintain an angle of inclination of the bed portion with respect to the surface when the hinge is locked and to allow the bed portion to fold against the stand when the hinge is unlocked.

* * * * *